United States Patent [19]

Simson

[11] 4,366,845

[45] Jan. 4, 1983

[54] NOZZLE ASSEMBLY

[75] Inventor: Dionizy Simson, Winterthur, Switzerland

[73] Assignee: Sulzer Brothers Limited, Winterthur, Switzerland

[21] Appl. No.: 173,606

[22] Filed: Jul. 30, 1980

[30] Foreign Application Priority Data

Aug. 8, 1979 [EP] European Pat. Off. ..... 79 102848.3

[51] Int. Cl.[3] ..... D03D 47/30

[52] U.S. Cl. ..... 139/435; 226/97

[58] Field of Search ..... 139/435; 226/97

[56] References Cited

U.S. PATENT DOCUMENTS 3,180,368 4/1965 Kobayashi ..... 139/435

FOREIGN PATENT DOCUMENTS

| | | | |
|---|---|---|---|
| 227199 | 5/1963 | Austria | 139/435 |
| 19784 | 12/1980 | European Pat. Off. | 139/435 |
| 2900144 | 7/1979 | Fed. Rep. of Germany | 139/435 |
| 365346 | 12/1962 | Switzerland | 139/435 |
| 610366 | 4/1979 | Switzerland | 139/435 |

OTHER PUBLICATIONS

A Study on Air-Jet Looms by Uno et al., Journal of the Textile Machinery Society of Japan, (Jul. 1961), p. 28.

*Primary Examiner*—Henry Jaudon

*Attorney, Agent, or Firm*—Kenyon & Kenyon

[57] ABSTRACT

The nozzle assembly employs a guide tube between successive nozzles to reliably convey a yarn from one nozzle to the other. The guide tube provides for a practically constant flow of velocity in a central zone so that the yarn is not deflected from the central zone. The guide tube can be axially adjusted along the outflow tube of one nozzle assembly.

12 Claims, 6 Drawing Figures

NOZZLE ASSEMBLY

This invention relates to a nozzle assembly. More particularly, this invention relates to a weft yarn insertion nozzle assembly for a weaving machine.

As is known, weaving machines are usually provided with a picking mechanism for inserting weft yarns into a shed. In some cases, where the weaving machines are of the jet type, for example air jet types, nozzle assemblies have been used to insert a weft yarn. In one known nozzle assembly, for example, as described in U.S. Pat. No. 4,133,353, two insertion nozzles are mounted in spaced coaxial relation to pick a yarn into a shed. However, a clearance exists between an exit opening of the first nozzle and an entrance opening of the following nozzle. Thus, the air jet issuing from the first nozzle can pass out into the surrounding environment to a large extent. As a result, the yarn may be deflected into the surrounding environment before entering the following nozzle. This is not advantageous, particularly, when threading a new weft yarn through the nozzles of the assembly.

Accordingly, it is an object of the invention to convey a yarn through a nozzle assembly having a plurality of nozzles in a reliable manner.

It is another object of the invention to maintain a weft yarn in a picking path during passage through a series of nozzles of a weft insertion nozzle assembly.

Briefly, the invention provides a nozzle assembly for a weaving machine which is comprised of at least two successively disposed insertion nozzles and a guide tube between the nozzles.

Each insertion nozzle is formed with a passage of predetermined cross-sectional area for conveying a yarn therethrough as well as with an inlet opening for the yarn at one end of the passage and an outlet opening for the yarn at an opposite end of the passage.

The guide tube is disposed between the outlet opening of one nozzle and the inlet opening of the following nozzle and has a passage of a cross-sectional area greater than the passages of the nozzles for conveying a yarn from one nozzle to the other nozzle. The cross-sectional area of the guide tube passage is sized relative to the nozzle passages such that a practically constant flow velocity is obtained within a large central zone of the guide tube. Thus, the yarn is carried forward practically only in this central zone. The peripheral zone of the guide tube conducts a flow of reduced velocity which is of relatively small value compared to the flow velocity in the central zone. The peripheral zone, thus, exerts practically no influence on the yarn so that the yarn is not deflected from the central zone. As a result, the weaving operation and the threading in of new weft yarns, for instance after a weft yarn rupture, are favorably affected. Further, the flow of air can be readily guided in the area between the two nozzles.

These and other objects and advantages of the invention will become more apparant from the following detailed description taken in conjunction with the accompanying drawings wherein:

FIG. 1 illustrates a cross-sectional view through a nozzle assembly constructed in accordance with the invention;

FIG. 1*a* illustrates a modified relationship between a guide tube and a following insertion nozzle of the assembly of FIG. 1;

FIG. 1*b* diagramatically illustrates a velocity diagram of the relationships between the outflow channel and guide tube of the assembly of FIG. 1;

Figures 1, 1A, 1B, 2, 3, 4:
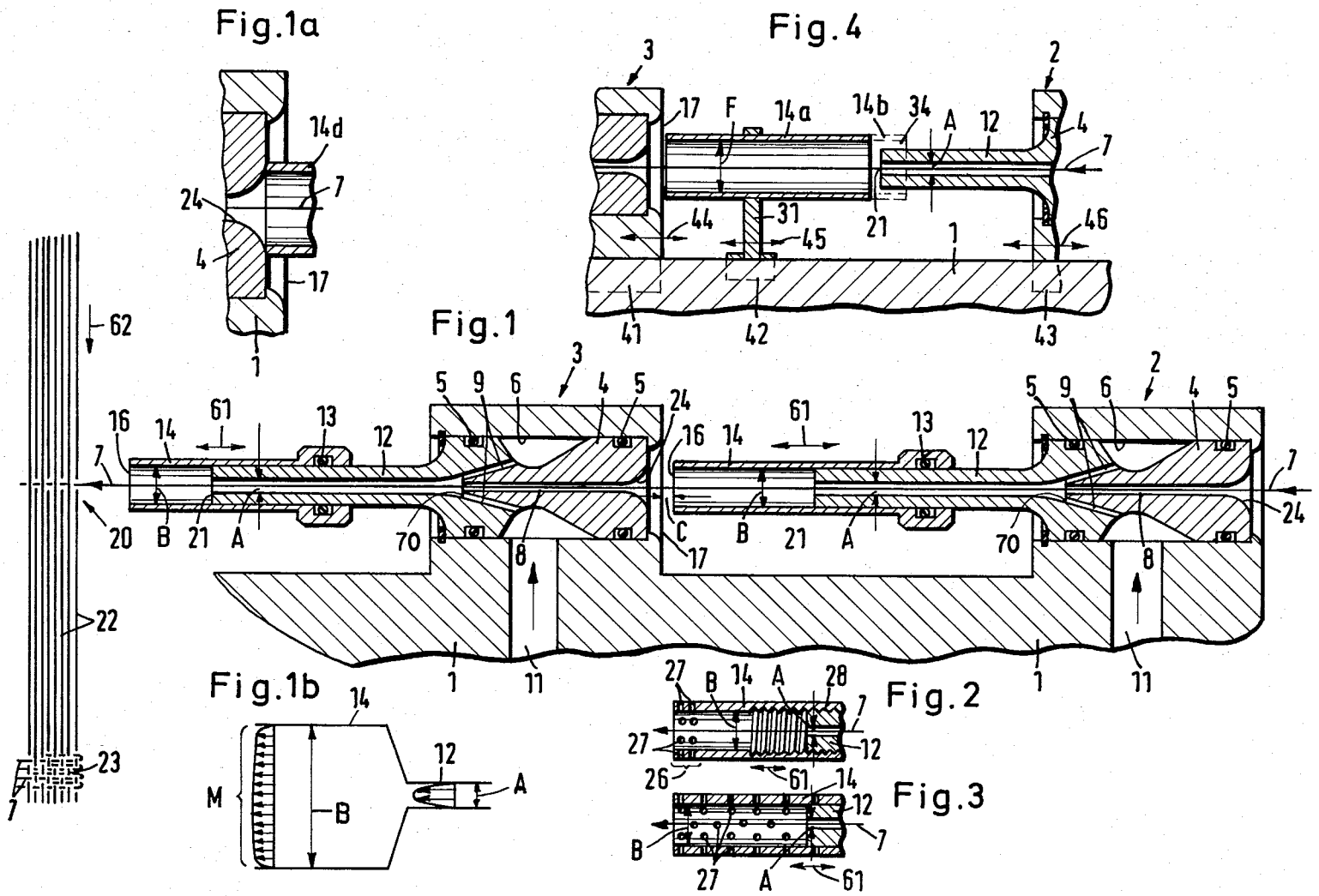
FIG. 2 illustrates a modified guide tube in accordance with the invention.
FIG. 3 illustrates further modified guide tube having perforations in accordance with the invention.
FIG. 4 illustrates a cross-sectional view of a further modified nozzle assembly according to the invention.

Referring to FIG. 1, the weft yarn insertion nozzle assembly is disposed at one side of the weaving machine (not shown). As indicated, the nozzle assembly is adapted to insert or pick a weft yarn 7 coming from a weft thread supply bobbin (not shown) into a shed 20 formed by a multiplicity of warp yarns 22 for forming a fabric 23. The weaving machine has suitable means for forming the shed 20 of warp yarns 22. As such means are well known, no further description is believed to be necessary.

The nozzle assembly includes a housing 1 in which two successive nozzles 2, 3 are formed. As shown, each nozzle 2, 3 contains a nozzle body 4 which is inserted into a bore 6 of the housing 1. Each body 4 includes suitable annular grooves in which annular seals 5, such as rubber rings are mounted for sealing against the bore 6. Each nozzle body 4 contains a passage 8 through which the weft yarn 7 is directed in a picking direction towards the shed 20. This passage is circumferentially surrounded by a plurality of air admission channels 9 which are fed with air from air feed ducts 11 in the housing via a reduced peripheral section of the body 4. The passage 8 and channels 9 merge via an air inlet point 70 into a passage of predetermined cross-sectional area A which is formed in an outflow channel or tube 12 extending from the body 4 towards the following nozzle 3 or shed 20.

In addition, the nozzle assembly has a guide channel in the form of a tube 14 following the outflow channel or tube 12 which is movable in the picking direction. As shown, the tube 14 includes an annular recess at one end which receives a seal ring 13, for example a rubber ring, for sealing against the outer periphery of the outflow tube 12. The guide tube 14 is mounted for a linear back-and-forth motion as indicated by the arrow 61. In addition, each guide tube 14 defines a passage with a cross-sectional area B greater than the cross-sectional area A of the outflow tube passage, for example from 4 to 8 times greater. Each guide tube 14 has an outlet 16 at the free end which is directed towards the following nozzle 3 or the shed 20, respectively.

As shown, the guide tube 14 of the nozzle 2 can be displaced to the left, as viewed, to the extent that a small gap C of, for example 1 to 2 millimeters, exists between the outlet end 16 and an inlet opening 17 of the following nozzle 3. Depending upon the operation of the weaving machine, this gap C can be adjusted by movement of the guide tube 14. For example, as viewed in FIG. 1*a*, the guide tube 14*d* can be abutted against the body 4 of the following nozzle 3 so that the guide tube 14*d* protrudes into the inlet opening 17 to abut against an inflow funnel 24 of the body 4. In this case, little or no air can issue into the surrounding environment.

Referring to FIG. 1*b*, the velocity of the air leaving the nozzle 2 at the outlet opening 21 of the outflow tube 12 is greatly reduced by the enlargement of the flow cross-section from A to B. Thus, a relatively large middle region M can be formed across the cross-section B in which there is practically constant velocity. By comparison, the velocity in the peripheral regions are negligibly small. This has a stabilizing effect on the passage of the yarn as the yarn has an increased tendency to remain in the central region. It is to be noted that a part of the air can issue into the surrounding environment via the gap C (see FIG. 1) while the remaining portion passes into the inflow opening 17 of the following nozzle 3.

In a corresponding manner, the guide tube 14 of the nozzle 3 can be brought relatively close to the shed 20 through which the warp yarns 22 pass in the direction indicated by the arrow 62.

Referring to FIG. 2, each guide tube 14 can be provided with two rows of perforations 27 at the free end 26. These perforations 27 allow a part of the air to pass into the surrounding environment, particularly in the case where the tube 14 protrudes into the inlet opening 17 of the nozzle 3 or abuts against the inflow funnel 24. In addition, as shown, the guide tube 14 can be threaded onto the outflow tube 12 via threads 28 such that the guide tube 14 is rotatably adjustable with respect to the outflow tube 12.

Referring to FIG. 3, the guide tube 14 may also be provided with a plurality of perforations over the full length. In this way, the amount of air issuing into the surrounding environment through the tube 14 can be adjusted by moving the tube 14 along the outflow tube 12.

Referring to FIG. 4, wherein like reference characters indicate like parts as above, a guide tube 14*a* is fixedly mounted in a holder 31 located between two nozzles 2, 3. The guide tube 14*a* is coaxially disposed between the outlet opening 21 of the outflow tube 12 and the inlet opening 17 of the following nozzle 3. As indicated, the guide tube 14*a* defines a passage with a cross-sectional area F substantially greater than the cross-sectional area A of the passage in the outflow tube 12 of the nozzle 2. Thus, a relatively large central air flow zone of practically constant velocity results within the guide tube 14*a* during operation.

The nozzles 2, 3 as well as the guide tube 14*a* may be mounted in a mutually displaceable and adjustable manner via respective guides 41, 42, 43 in the housing 1. As indicated, the nozzles 2, 3 and tube 14*a* may be moved in the directions indicated by the respective arrows 44, 45, 46. The tube 14*a* can thus be made to extend over the outlet tube 12 of the nozzle 2 at the end 14*b* to leave an annular clearance 34 through which a certain quantity of air can flow into the surrounding environment as well as into the tube 14*a*.

The invention thus provides a weft insertion nozzle assembly wherein a weft yarn can be maintained in a picking path while moving between spaced apart nozzles of the assembly in a simple reliable manner.

What is claimed is:

1. A nozzle assembly for a weaving machine comprising:

at least two successively disposed insertion nozzles, each said nozzle having a passage of predetermined cross-sectional area for conveying a yarn therethrough, an inlet opening for the yarn at one end of said passage and an outlet opening for the yarn at an opposite end of said passage; and a guide tube disposed between an outlet opening of one nozzle and in inlet opening of another nozzle, said guide tube being in sealed relation with said outlet opening and having a passage of a cross-sectional area greater than said passages of said nozzles for conveying a yarn therethrough from said one nozzle to said other nozzle.

2. A nozzle assembly as set forth in claim 1 wherein said guide tube is fixedly mounted between said nozzles.

3. A nozzle assembly as set forth in claim 1 wherein said guide tube has a plurality of perforations therein at least at one end adjacent said other nozzle.

4. A nozzle assembly as set forth in claim 1 wherein said passages of said nozzles have an equal cross-sectional area.

5. A nozzle assembly as set forth in claim 1 wherein said guide tube passage has a cross-sectional area four to eight times greater than said passages of said nozzles.

6. A nozzle assembly as set forth in claim 1 wherein said guide tube is sized relative to said passages of said nozzles to obtain a practically constant flow velocity within a central zone thereof.

7. A nozzle assembly as set forth in claim 6 wherein said guide tube has a plurality of perforations therein at least at one end adjacent said other nozzle.

8. A nozzle assembly for a weaving machine comprising:

at least two successively disposed insertion nozzles, each said nozzle having a first passage for a weft yarn, an air inlet point downstream of said passage, and an outflow tube having a second passage of predetermined cross-sectional area extending from said air inlet point for conveying a yarn therethrough; and a guide tube mounted on said outflow tube of one nozzle in sealed relation and extending towards said first passage of another nozzle, said guide tube having a passage of a cross-sectional area greater than said second passage of said one nozzle to said other nozzle.

9. A nozzle assembly as set forth in claim 8 wherein said guide tube is slidably mounted on said outflow tube.

10. A nozzle assembly as set forth in claim 8 wherein said first passages of said nozzles have an equal cross-sectional area.

11. A nozzle assembly as set forth in claim 8 wherein said guide tube passage has a cross-sectional area four to eight times greater than said passage of said outflow tube.

12. A nozzle assembly as set forth in claim 8 wherein said guide tube is sized relative to said passages of said nozzles to obtain a practically constant flow velocity within a central zone thereof.

* * * * *

UNITED STATES PATENT AND TRADEMARK OFFICE

CERTIFICATE OF CORRECTION

PATENT NO. : 4,366,845

DATED : January 4, 1983

INVENTOR(S) : DIONIZY SIMSON

It is certified that error appears in the above—identified patent and that said Letters Patent is hereby corrected as shown below:

Column 2, line 5, after "invention;" insert --and--

Column 2, line 7, delete "; and" and insert -- . --

Column 2, lines 8 and 9, delete "Fig. 4...invention;"

Column 3, lines 29 to 50, delete "Referring...14a"

Signed and Sealed this

*Twenty-first* Day of *June 1983*

[SEAL]

*Attest:*

DONALD J. QUIGG

*Attesting Officer*

*Acting Commissioner of Patents and Trademarks*